US006707922B2

(12) United States Patent
Tilbury et al.

(10) Patent No.: US 6,707,922 B2
(45) Date of Patent: Mar. 16, 2004

(54) DEFORMABLE LOUDSPEAKER

(75) Inventors: Nancy A. Tilbury, London (GB); Philippa C. Wagner, London (GB); Kyriakos J. Mama, Brighton (GB); Clive R. Van Heerden, New York, NY (US)

(73) Assignee: Koninklijke Philips Electronics N.V., Eindhoven (NL)

( * ) Notice: Subject to any disclaimer, the term of this patent is extended or adjusted under 35 U.S.C. 154(b) by 218 days.

(21) Appl. No.: 09/822,455

(22) Filed: Mar. 30, 2001

(65) Prior Publication Data

US 2001/0026627 A1 Oct. 4, 2001

(30) Foreign Application Priority Data

Mar. 31, 2000 (GB) ..... 0007866

(51) Int. Cl.[7] ..... H04R 1/02
(52) U.S. Cl. ..... 381/333; 181/153; 181/172
(58) Field of Search ..... 381/301, 333, 381/388, 87, 334; 2/209, 906, 79, 85, 93, 94, 95, 102, 115, 269

(56) References Cited

U.S. PATENT DOCUMENTS 3,670,321 A * 6/1972 Savides ..... 340/384.73
4,539,700 A 9/1985 Sato ..... 381/90
4,589,134 A * 5/1986 Waldron ..... 381/301
4,823,907 A * 4/1989 Hoshi ..... 181/148
4,860,364 A * 8/1989 Giannini ..... 381/333
5,265,165 A 11/1993 Rauch ..... 381/25
5,317,643 A * 5/1994 Patricelli ..... 381/376
5,437,061 A * 8/1995 Kenner ..... 2/69
6,270,831 B2 * 8/2001 Kumar et al. ..... 427/2.24
2001/0002000 A1 * 5/2001 Kumar et al. ..... 204/192.1

FOREIGN PATENT DOCUMENTS

EP 0773699 A1 5/1997 ..... H04R/1/00

* cited by examiner

*Primary Examiner*—Curtis Kuntz
*Assistant Examiner*—Brian Ensey
(74) *Attorney, Agent, or Firm*—Edward W. Goodman

(57) ABSTRACT

An audio speaker for incorporation into garments, upholstery, etc., has a diaphragm (10) and connecting wires (18) or switch (48), and a concave cover (20 or 44) made of a heat-molded textile having a ceramic textile covering. The speaker is attached by stitching (16) to an aperture (12) in a piece of conventional textile (14), for easy incorporation into a garment. The speaker may be sewn into the hood of a sports garment, or may be attached by the switch to a conducting area within a concave area of a garment such as a dress.

4 Claims, 2 Drawing Sheets

DEFORMABLE LOUDSPEAKER

BACKGROUND OF THE INVENTION

1. Field of the Invention

This invention relates to a loudspeaker of substantially, or at least partially, flexible construction suitable for incorporation into a garment or other soft object. The invention further relates to a garment including one or more such speakers.

2. Description of the Related Art

In U.S. Pat. No. 4,539,700 (Olympus Optical Company Limited), a personal portable audio device is provided in a garment, such as, a vest or waistcoat, by placing components, such as, a tape recorder and a power source, in pockets in the garment and by providing a conventional speaker in each shoulder of the garment, between the surface cloth and a lining. However, no special constructions of any component are disclosed, and it would appear that conventional speakers are used, so that attachment to the garment may not be easy.

In U.S. Pat. No. 4,860,364 (Giancarlo Giannini), a sound-generating garment is disclosed in which flexible switches are provided at the shoulders, elbows and knees, each arranged to provide a musical sound in response to movements of the wearer, but the musical sounds produced are naturally limited in range and complexity.

SUMMARY OF THE INVENTION

According to the invention, an audio speaker comprises a diaphragm, connection means for connecting the diaphragm to a source of electrical signals, and a concave cover comprising a heat-molded textile material having a ceramic textile coating. With such a construction, which may be achieved through use of conventional garment fabrication techniques, the resulting speaker has a greater or lesser degree of flexibility such as to make it suitable for incorporation into a garment or other such uses where a solid and rigid construction would result in discomfort for a user.

The concave cover may be arranged to form a back cover or a front cover for the diaphragm. Preferably, the diaphragm and the concave cover are secured in a central aperture of a piece of conventional textile, for incorporation into a garment.

Also in accordance with the invention, there is provided a garment or fabric item comprising an audio speaker as described above. Such a garment or fabric item may comprise a plurality of concave areas on the outside surface, with each such concave area having a conductive area co-operable with a conductive switch on the rear of the audio speaker.

Alternatively, such a garment may include a hood portion and comprise a pair of the audio speakers within the hood at respective locations, such as to be over the users ears when the hood is worn, as an alternative to the user wearing headphones. With such a garment, the hood portion preferably includes a zipper portion through separation of which the respective speakers may be moved to positions on shoulder portions of the garment, thereby allowing the wearer of the garment to chose between listening to output of the speakers alone (hood up) or with others (hood down).

BRIEF DESCRIPTION OF THE DRAWINGS

The invention will now be described by way of example with reference to the accompanying drawings in which.

DESCRIPTION OF THE PREFERRED EMBODIMENTS

Figure 1:
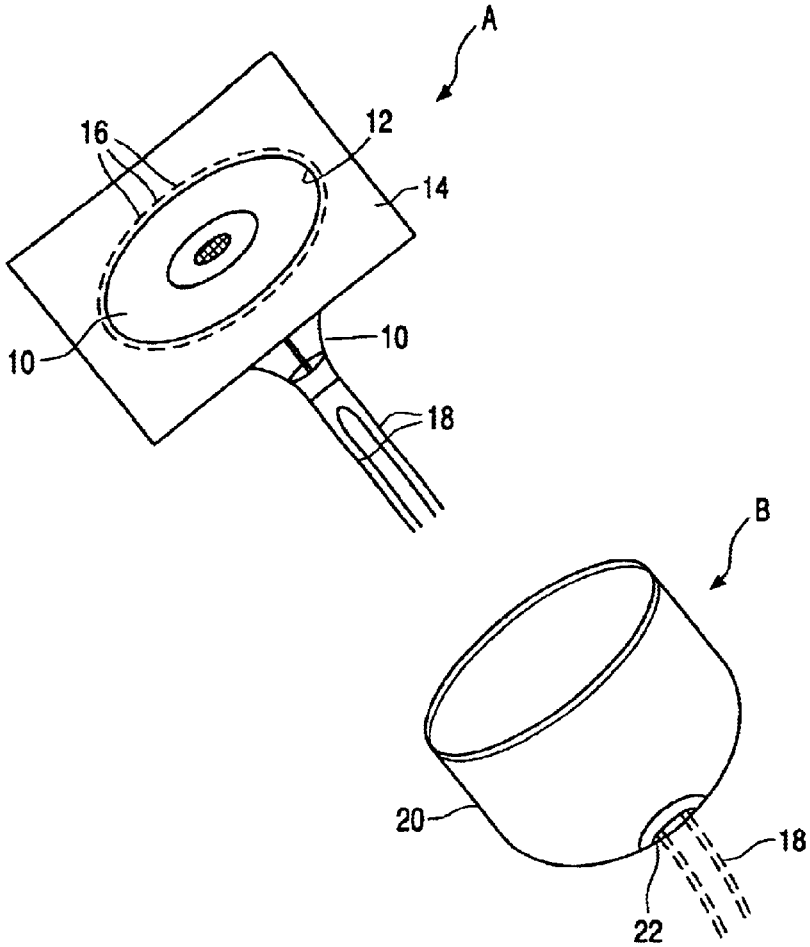
FIG. 1 shows, in disassembled form, a first embodiment of a loudspeaker.

In FIG. 1, a loudspeaker comprises a speaker part A and a backing part B. In part A, a conventional audio speaker diaphragm 10 is attached to a central aperture 12 in a piece of conventional textile material 14 by stitching 16. Connecting wires 18 supply electrical signals, in the form of audio signals, to the speaker diaphragm 10.

Part B comprises a cup 20 formed of heat molded Neoprene (Trademark) textile with a ceramic textile acoustic coating. The cup 20 may be formed by techniques used in the textile industry to manufacture seamless brassiere cups, then coated with ceramic by known techniques. The cup has a central aperture 22 through which the wiring 18 (shown dotted) may pass when the speaker is assembled. Assembly is achieved by placing the cup 20 around the back of the diaphragm 10 and stretching the fabric 14 so that the speaker part A is recessed within the cup 20.

In a variation, instead of stitching the loudspeaker to the fabric 14, the loudspeaker can be directly fused to an aperture in an appropriate fabric.

Figure 2:
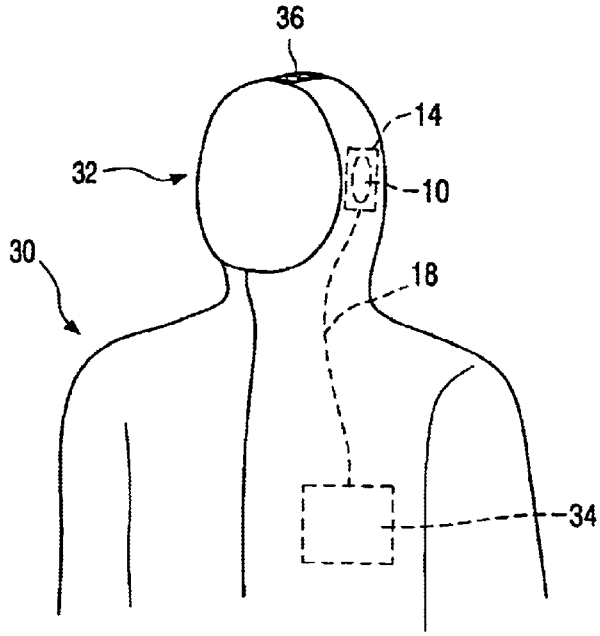
FIG. 2 shows a garment incorporating the speaker of the first embodiment.

Once assembled, the loudspeaker is of semi-flexible nature, and the fabric layer 14 can easily be sewn into a garment. FIG. 2 shows a sportswear garment 30 having a hood 32 to which the speaker is attached by the fabric 14, with the diaphragm 10 directed towards the inside of the hood and the cup 20 towards the outside. An audio player 34 is positioned, for example, in an inside pocket of the garment and connected to the speaker by wires 18. The wearer of such a garment can listen to music while walking outside without the inconvenience of headphones or an earpiece. By providing the hood with a zipper 36 to allow unzipping to form a goose neck style jacket, a companion walking alongside can share the music from the speaker. Alternatively, the wiring 18 can be connected to mobile telephone equipment or to a PDA.

Figure 3:
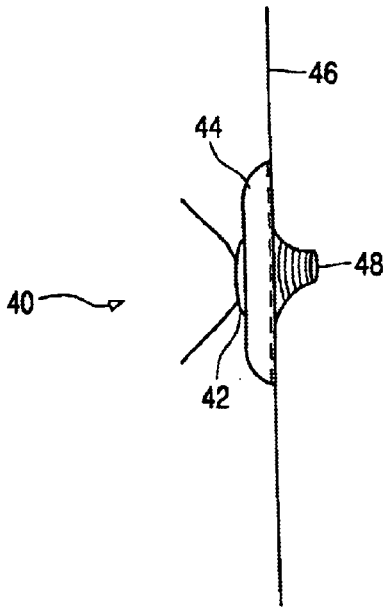
FIG. 3 shows, in section, a second embodiment of a loudspeaker.

In FIG. 3, a loudspeaker 40 comprises a conventional speaker 42 mounted in an acoustic textile ceramic molded cover 44 and attached to a piece of fabric 46. In this embodiment, instead of the wiring 18 of FIG. 1, electrical connection to the loudspeaker 40 is provided by a conductive switch 48 protruding through the fabric 46 on the opposite side to the diaphragm of the speaker. The switch 48 may be made of conductive rubber or other suitable material.

Figure 4:
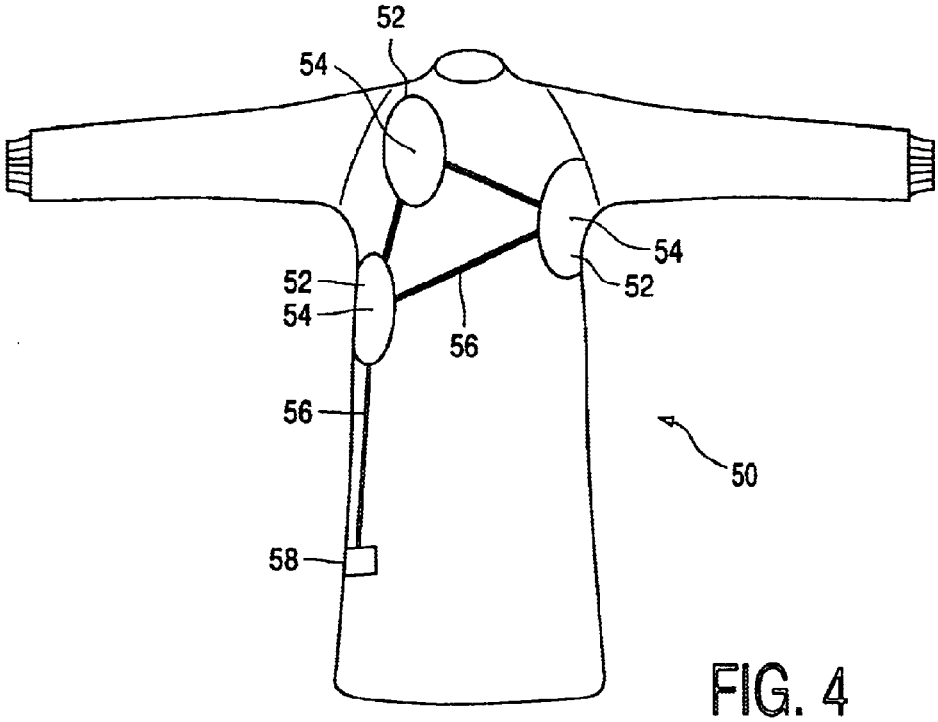
FIG. 4 shows a garment incorporating several speakers of the second embodiment.

FIG. 4 illustrates one application of the speaker of FIG. 3. A dress 50 is made of rubber such as Neoprene (Trademark), and is provided with three concave areas 52 each having a central conductive area 54 co-operable with the conductive switch 48. The conductive areas may be made of conductive textile material. The conductive areas 54 are connected by wiring 56 on the inside of the dress to a power source and audio source 58, also concealed on the inside of the dress.

By attaching a speaker to one or two or all three of the concave areas 52, the dress may act as a walking sound device. Alternatively, the dress can be hung up in a selected position to act as a temporarily fixed sound device. If two or three speakers are connected, they may be arranged to output the same or different sounds.

Either the FIG. 1 or FIG. 3 embodiment of a flexible speaker may also be incorporated into any other object requiring flexibility, for example, into upholstered seating, or in other circumstances when a lightweight, robust speaker is required.

From reading the present disclosure, other modifications will be apparent to persons skilled in the art. Such modifications may involve other features which are already known in the design, manufacture and use of audio systems, components for garments and applications thereof and which may be used instead of or in addition to features already described herein.

What is claimed is:

1. A garment comprising a hood portion and a pair of audio speakers mounted within the hood portion at respective locations such as to be over a user's ears when the hood portion is worn, each of said audio speakers comprising:

a diaphragm;

connection means for connecting the diaphragm to a source of electrical signals;

a concave cover comprising a heat-molded textile having a ceramic textile coating; and means for mounting the diaphragm to the concave cover, wherein the hood portion includes a zipper portion, whereby when said zipper portion is unzipped, the respective audio speakers may be moved to positions on shoulder portions of the garment.

2. The garment as claimed in claim 1, wherein the concave cover is arranged to form a front cover for the diaphragm.

3. The garment as claimed in claim 1, wherein the connection means comprises a conductive switch at the rear of the speaker.

4. The garment as claimed in claim 1, wherein the concave cover is arranged to form a back cover for the diaphragm.

* * * * *